US010787342B2

(12) United States Patent
Okonski et al.

(10) Patent No.: US 10,787,342 B2
(45) Date of Patent: Sep. 29, 2020

(54) WHEELCHAIR LIFT APPARATUS

(71) Applicant: Wheelchair Escalators, LLC, Farmington Hills, MI (US)

(72) Inventors: Raymond N. Okonski, Farmington Hills, MI (US); Nassif E. Rayess, Warren, MI (US); Darrell K. Kleinke, Livonia, MI (US); Christopher M. Sassak, Dearborn, MI (US); George Taro, Canton, MI (US); Evan Jeffries, Farmington Hills, MI (US)

(73) Assignee: Wheelchair Escalators, LLC, Farmington Hills, MI (US)

( * ) Notice: Subject to any disclaimer, the term of this patent is extended or adjusted under 35 U.S.C. 154(b) by 352 days.

(21) Appl. No.: 15/277,659

(22) Filed: Sep. 27, 2016

(65) Prior Publication Data

US 2018/0086601 A1 Mar. 29, 2018

(51) Int. Cl.
*B66B 9/08* (2006.01)

(52) U.S. Cl.
CPC ..... *B66B 9/08* (2013.01); *B66B 9/083* (2013.01); *B66B 9/0853* (2013.01)

(58) Field of Classification Search
CPC ..... B66B 9/08; B66B 9/083; B66B 9/0853
See application file for complete search history.

(56) References Cited

U.S. PATENT DOCUMENTS 319,119 A * 6/1885 Pentz ..... B66B 9/08 414/600
1,358,062 A * 11/1920 Howlett ..... B66B 9/083 187/201
2,528,265 A * 10/1950 Cretors ..... B66B 9/083 187/201
3,229,788 A * 1/1966 Booth ..... A61G 3/06 182/148
3,312,307 A * 4/1967 Camp ..... B61B 9/00 187/245
3,749,202 A * 7/1973 Puls ..... B66B 9/083 182/103
4,043,427 A * 8/1977 Ackerman ..... B66B 9/083 187/201
4,345,669 A * 8/1982 Noall ..... B66B 9/083 182/103
4,438,830 A * 3/1984 Born ..... B66B 9/083 187/201
5,050,708 A * 9/1991 Wood ..... B66B 9/0838 187/201
5,105,741 A * 4/1992 Leary ..... E01B 23/00 104/106
5,272,984 A * 12/1993 Bolliger ..... A63G 7/00 104/63
5,316,432 A * 5/1994 Smalley ..... B60R 3/02 187/200

(Continued)

*Primary Examiner* — Michael A Riegelman
(74) *Attorney, Agent, or Firm* — Brooks Kushman P.C.

(57) ABSTRACT

A wheelchair lift apparatus that includes a stand that includes a pair of inclined rails; and a platform adapted to carry a wheelchair, wherein the platform includes a driving portion and a driven portion for moving the platform along the rails, wherein, when the driving portion actuates the driven portion in a first direction, the platform ascends along the rails, wherein, when the driving portion actuates the driven portion in a second and opposite direction, the platform descends along the rails.

20 Claims, 7 Drawing Sheets

(56) References Cited

U.S. PATENT DOCUMENTS 5,553,548 A * 9/1996 Eaton ..... A61G 5/061 104/183
5,553,990 A * 9/1996 Kytola, Sr. ..... B66B 9/04 182/146
5,672,041 A * 9/1997 Ringdahl ..... A61G 3/06 414/540
6,039,528 A * 3/2000 Cohn ..... B60P 1/4457 414/546
6,053,693 A * 4/2000 Ringdahl ..... A61G 3/06 187/306
6,062,805 A * 5/2000 Tremblay ..... A61G 3/06 414/540
6,105,726 A * 8/2000 Taylor ..... B66B 9/0838 187/201
6,360,833 B1 * 3/2002 Valencia ..... A61G 5/061 180/7.5
6,435,804 B1 * 8/2002 Hutchins ..... B60P 1/4414 187/200
6,478,525 B2 * 11/2002 Hageman ..... B65G 69/005 188/32
6,854,147 B1 * 2/2005 Ahlsten ..... B64D 9/00 14/69.5
7,395,900 B2 * 7/2008 Murray ..... B66B 9/0869 187/200
7,537,069 B2 * 5/2009 Kramer ..... A47C 7/62 180/21
7,954,602 B2 * 6/2011 Stanislao ..... B66B 9/083 187/200
8,113,760 B1 * 2/2012 Schroll ..... A61G 3/06 414/522
8,146,713 B2 4/2012 Rosenthal
9,751,702 B1 * 9/2017 Hoofard ..... B65G 69/005
2001/0048872 A1 * 12/2001 Sardonico ..... B60P 1/445 414/556
2002/0011383 A1 * 1/2002 Grass ..... B66B 9/0853 187/201
2002/0098077 A1 * 7/2002 Beech ..... B66B 9/08 187/201
2003/0146055 A1 * 8/2003 Hill ..... B66B 9/06 187/245
2005/0077111 A1 * 4/2005 Sobota ..... B66B 9/08 187/202
2005/0150064 A1 * 7/2005 Hill ..... B63B 27/143 14/71.1
2005/0238471 A1 * 10/2005 Ablabutyan ..... A61G 3/06 414/546
2006/0104775 A1 * 5/2006 Kasten, Jr. ..... B60P 1/4457 414/546
2007/0161460 A1 * 7/2007 Katz ..... A63G 21/00 482/35
2007/0224025 A1 * 9/2007 Ablabutyan ..... B60P 1/4442 414/546
2008/0093176 A1 * 4/2008 Rosenthal ..... B66B 9/083 187/241
2015/0375965 A1 * 12/2015 Awerbuch ..... B66B 9/08 187/201
2018/0086601 A1 * 3/2018 Okonski ..... B66B 9/08

* cited by examiner

WHEELCHAIR LIFT APPARATUS

TECHNICAL FIELD

The present invention relates to a wheelchair lift apparatus.

BACKGROUND

Typically, when a wheelchair user encounters stairs or other obstacles which the wheelchair is incapable of safely traversing along the user's designated path or route, the user must either have manual assistance or elect another route. For example, two or more individuals manually may lift the user in the wheelchair up or down a flight of stairs. Or the user may in some instances seek and find special accommodations for those with disabilities e.g., a wheelchair ramp or the like. However, some public buildings and many private residences, among other things, do not have such accommodations. Further, by standing individuals may not be present or able to assist the wheelchair user in these circumstances. Thus, there is a need to provide a means for the wheelchair user to move in the wheelchair between platforms or paths having different heights or elevations (e.g., to negotiate stairs and the like).

SUMMARY

According to an embodiment of the invention, there is provided a wheelchair lift apparatus that includes a stand that includes a pair of inclined rails; and a platform adapted to carry a wheelchair, wherein the platform includes a driving portion and a driven portion for moving the platform along the rails, wherein, when the driving portion actuates the driven portion in a first direction, the platform ascends along the rails, wherein, when the driving portion actuates the driven portion in a second and opposite direction, the platform descends along the rails.

According to another embodiment of the invention, there is provided a wheelchair lift apparatus for a stairway that includes a stand that includes an upper support, a lower support, and a pair of rails coupling the upper and lower supports to one another; and a platform adapted to carry a wheelchair-bound individual, wherein the platform includes a driving portion and a driven portion for moving the platform along the rails, wherein, when the driving portion actuates the driven portion in a first direction, the platform ascends along the rails, wherein, when the driving portion actuates the driven portion in a second and opposite direction, the platform descends along the rails.

BRIEF DESCRIPTION OF THE DRAWINGS

One or more embodiments of the invention will hereinafter be described in conjunction with the appended drawings, wherein like designations denote like elements, and wherein.

DETAILED DESCRIPTION OF THE ILLUSTRATED EMBODIMENT(S)

Figure 1:
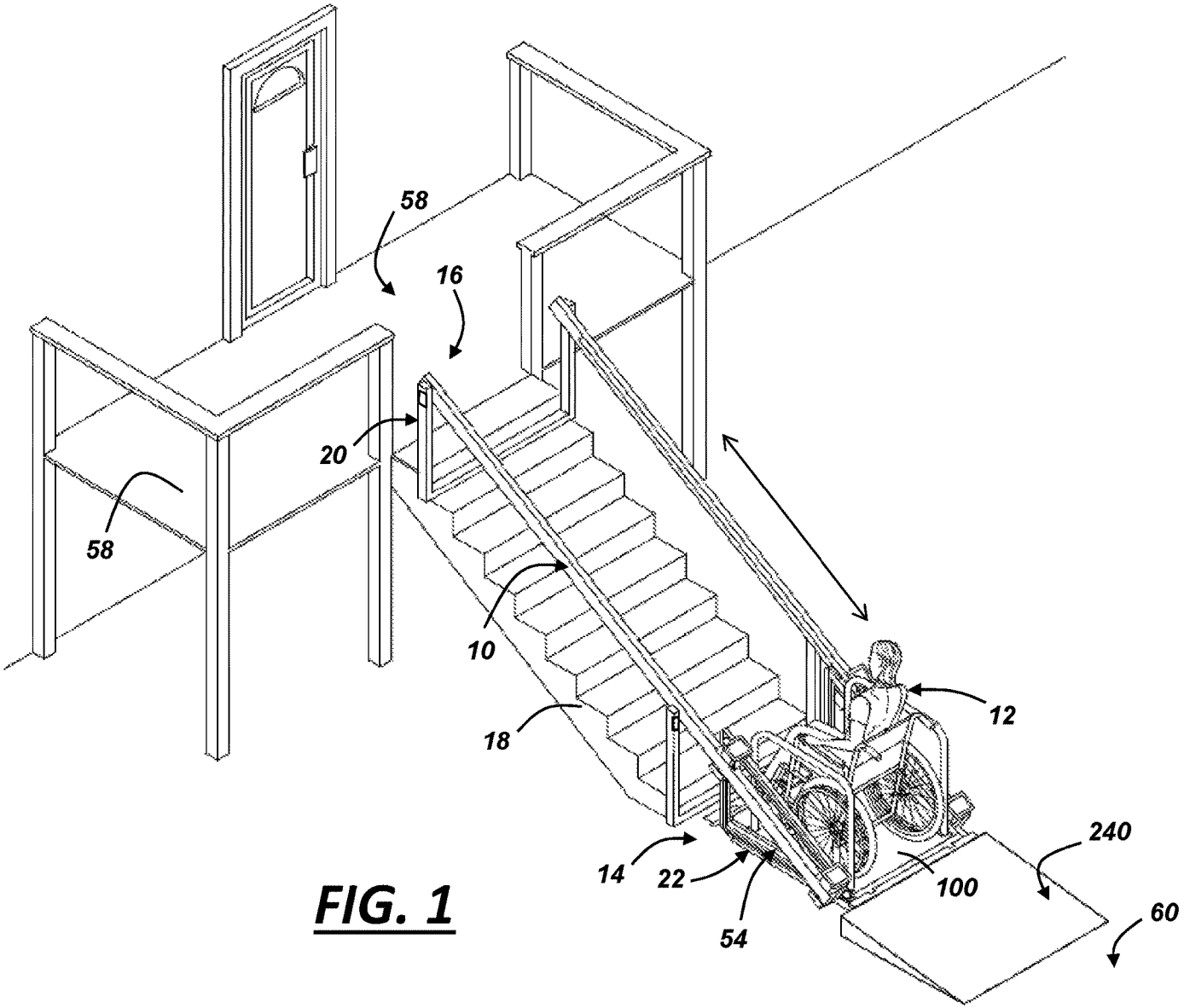
FIG. 1 illustrates a perspective view of a wheelchair lift apparatus in an exemplary environment.
Figure 7:
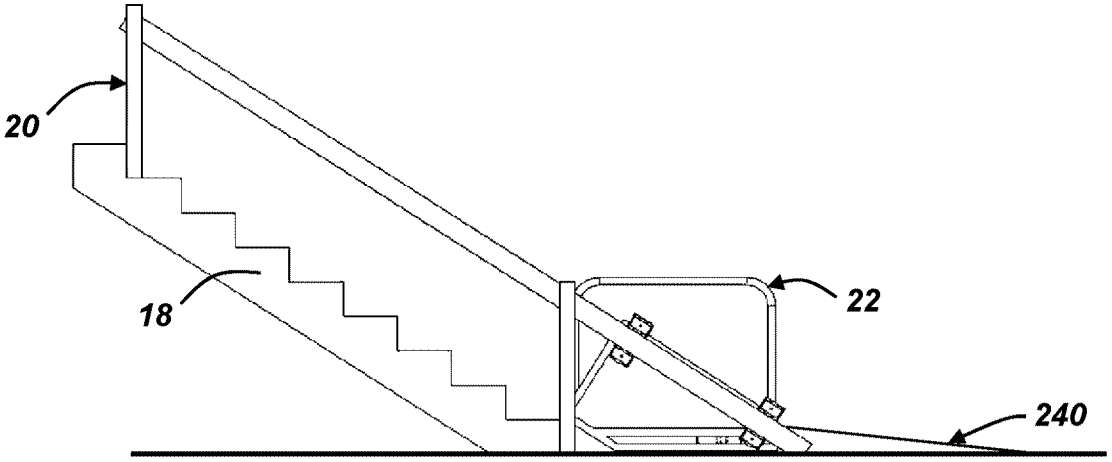
FIGS. 7-8 illustrate side views of the wheelchair lift apparatus, wherein the platform assembly is respectively in a lower position and in an upper position.
Figure 8:
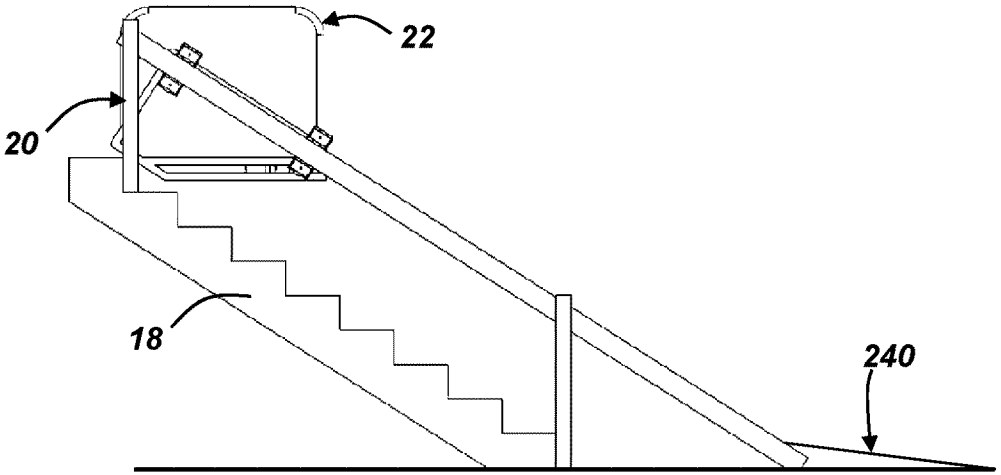

A wheelchair lift apparatus or assembly 10 is described herein that transports a wheelchair (or wheelchair-bound individual) 12 between a bottom or lower position 14 and to a top or upper position 16 of an obstacle 18 (or vice-versa), as shown in FIGS. 1, 7-8. More particularly, the apparatus 10 of FIG. 1 includes a stand 20 and a mobilized platform assembly or platform 22 carried by the stand 20 that enables a wheelchair-bound person 12 to ascend or descend over the stairs 18. Further, when the apparatus 10 is not in use, it does not inhibit foot-traffic use of the stairs 18 (e.g., by those not in wheelchairs). For example, as will be explained in greater detail below, when the apparatus 10 is not in use, non-wheelchair-bound individuals may step onto the platform 22, walk through the platform 22, and traverse the stairs 18. Furthermore, as will become apparent from the description below, the apparatus 10 is generally modular, does not require time-intensive installation, nor does it need to be fixed to or coupled to existing structure (e.g., to the stairway, to an adjacent interior or exterior wall, to a stairway handrail, etc.). For example, it can be a stable, freestanding solution for wheelchair-bound individuals desiring to traverse stairs. As used herein, the term lift apparatus (or lift assembly) includes an apparatus that lifts or raises an object and/or individual, an apparatus that lowers an object and/or individual, or a combination thereof.

Figures 2, 5:
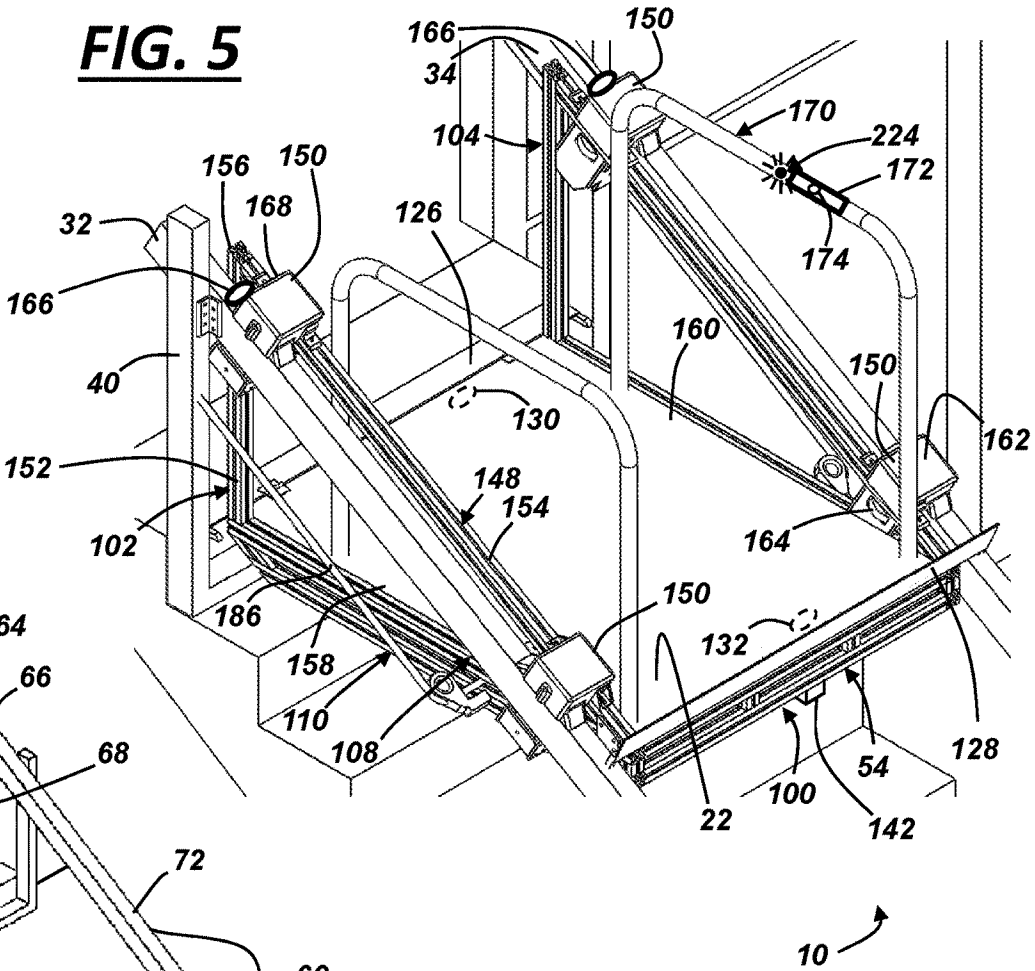
FIG. 2 illustrates a perspective view of a stand of the lift apparatus located on a stairway.
FIG. 5 illustrates an enlarged perspective view of a portion of the wheelchair lift apparatus on the stairway.

As shown in FIG. 2, the stand 20 of the apparatus 10 may include two or more supports 28, 30 and two guide rails 32, 34 which couple the supports 28, 30 to one another. The upper and lower supports 28, 30 may be identical; therefore, only one will be described.

The illustrated support 30 includes a U-shaped body 36 having an axially extending base member 38 and two upright members 40, 42 extending radially outwardly therefrom. More particularly, the upright members 40, 42 may be identical to one another and may extend in parallel; however, this is not required. For example, each upright member 40, 42 may extend at a right angle with respect to the base member 38; however, this is not required. Further, in at least one embodiment, the upright members 40, 42 may have features enabling adjustment in length (e.g., they may be telescopic or otherwise extendable). While a U-shaped body 36 is shown, other shapes are also contemplated.

According to one embodiment, the support 30 may be formed in a single, unitary piece—e.g., using extrusion, bending, welding, and/or other suitable manufacturing techniques; however this is not required. For example, in one non-limiting example, the support 30 may be comprised of three extruded aluminum pieces which each have a rectangular cross-section and are adjoined by welding. Of course, this is merely one non-limiting example; further, the support 30 may be comprised of any suitable metal, plastic, or other material.

Figure 11:
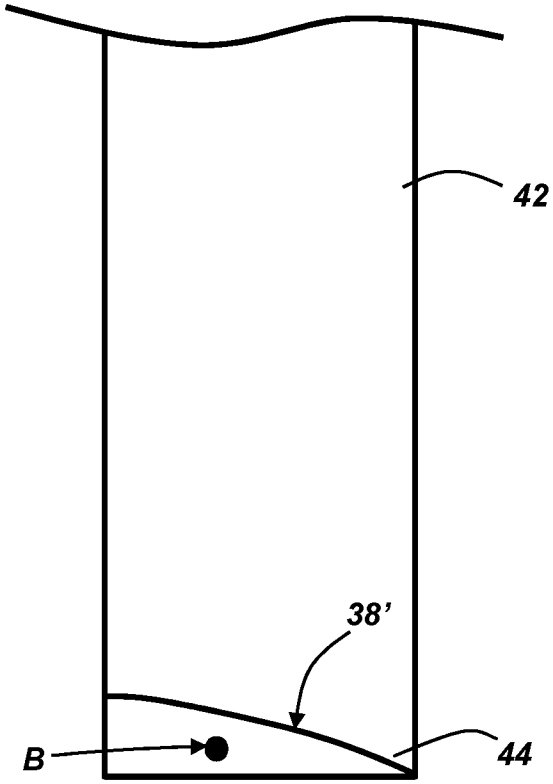
FIG. 11 is a cross-sectional view of another embodiment of a base member of a support.

Thus, in one embodiment, a diameter of the upright members 40, 42 and the base 38 member may be generally uniform. Further, the diameter of the base member 38—adapted for foot traffic to pass thereover—may have a generally low profile. And in at least one other embodiment (as shown in FIG. 11), a base member 38' may be shaped as a generally flat bar which has at least one axially extending edge that tapers 44 radially outwardly from a longitudinal axis B (of the base member 38'). The tapered edge 44 may promote safety by inhibiting non-wheelchair-bound individuals from tripping on the base member 38' as they traverse the stairway 18 on foot, as will be explained more below.

Returning to FIG. 2, in at least one implementation, a user interface device (50, 52) is located at or on each of the upper and lower supports 28, 30 (or even on rail). For example, the user interface devices 50, 52 may be integral to one of the upright members 40, 42, or the devices 50, 52 may be detachable therefrom. The user interface devices 50, 52 may include a transceiver (not shown) and may be adapted to communicate by wire or wirelessly with platform electronics 54 (shown in FIGS. 1 and 6) as will be explained in greater detail below. In at least one embodiment, the devices 50, 52 include wireless transceivers and communicate according to any suitable short range wireless communication (SRWC) protocol (e.g., such as Wi-Fi, Bluetooth, BLE, and the like).

More particularly, the upper user interface device 52 may include a call switch 56 that enables a wheelchair-bound individual at an upper level or landing 58 of the stairway to retrieve or call the platform when it is located at a lower level 60 (e.g., a lower floor or ground); see FIGS. 1-2. Similarly, the lower user interface device 50 may include a call switch 62 that enables a wheelchair-bound individual 12 at the floor 60 to retrieve or call the platform 22 which may be located at the landing 58.

Figure 10:
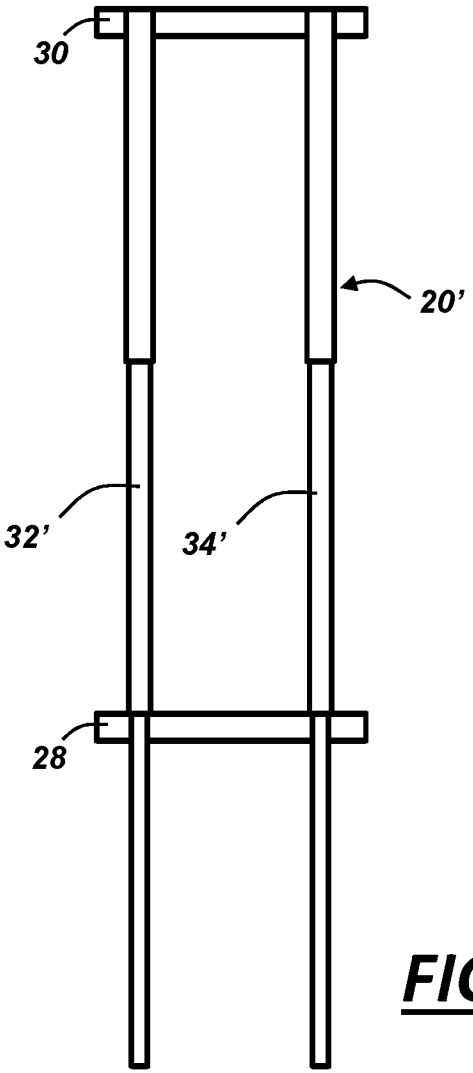
FIG. 10 is a top view of embodiment of a stand having telescopic guide rails.

As shown in FIG. 2, the guide rails 32, 34 of the stand 20 also may be identical; therefore, only one will be described. According to one embodiment, the rail 34 may include an axially extending body 64 adapted to support the platform 22 weight. According to one embodiment, each rail 32, 34 may be formed in a single, unitary piece—e.g., using extrusion and/or other suitable manufacturing techniques; however this is not required. For example, in one non-limiting example, the rail 34 may be comprised of a single extruded aluminum piece which has a rectangular cross-section. Of course, the rail 34 may be comprised of any suitable metal, plastic, or other material. Other rail implementations include multi-piece, telescopic rails 32', 34' such as those shown in FIG. 10.

As will be explained in greater detail below, the body 64 of the rail 34 may have a first or upper axially extending track region 66, a second or bottom axially extending track region 68, and a third or lateral axially extending track region 70. The rail 34 may be arranged so that the lateral track region 70 faces inboard—e.g., so that it faces a corresponding lateral track region 70 (of the other rail 32 which also faces inboard). The rail 34 may extend between the upper and lower supports 28, 30 and at least an additional or extending portion of the rail 72 may extend between the lower support 28 and the floor 60, as shown in FIG. 2. As shown in the accompanying figures (see FIGS. 1 and 7), this extending portion 72 enables the platform 22 to traverse along the rails 32, 34 so that the platform 22 may be nearer to the floor 60.

For example, the extending portion 72 of the rail 32 (as well as rail 34) may contact or nearly contact the floor 60. In instances where the portions 72 touch the floor 60, these extending portions 72 may provide additional stability to the stand 20. As will be explained below, the length of the extending portions 72 may correspond to one or more dimensions of the platform 22.

In one implementation, at least one guide rail 34 includes a stop or abutment 76 extending radially outwardly of the rail 34. For example, in FIG. 2, two are shown; and in this illustrative example, the stops are nearer the respective upper ends 78, 80 of the guide rails 32, 34 on the upper track regions 66. In other embodiments, the stops 76 could protrude from the lower region(s) 68, the lateral track region(s) 70, or any other suitable part of the guide rails 32, 34. As will be explained more below, this stop 76 may be used to limit travel of platform 22 along the rail 34.

The illustrated rails 32, 34 are shown coupled to the supports 28, 30 on inboard sides 82, 84 of the upright members 40, 42; however, this is not required. For example, the rails 32, 34 could be coupled to the respective ends (or tops) of the upright members 40, 42 or in any other suitable fashion that permits the platform 22 to traverse therebetween. The coupling of the rails 32, 34 to the supports 40, 42 should be construed broadly to include using any suitable fasteners (e.g., clips, bolts, screws, pins, etc.), weldments, keying features, and the like. In at least one embodiment, fasteners are used to assemble the rails 32, 34 to the supports 40, 42 enabling the easier transport, assembly, and disassembly of the lift apparatus 10.

When the stand 20 is assembled, the lower support 28 may be located on the floor 60 and the upper support 30 may be located near the landing 58. More particularly, in implementations where the wheelchair lift apparatus 10 is used on stairs 18, the upper support 30 may be located on a first step 90 just below the landing 58. While this is not required, this more generally may align the platform 22 with a surface 92 of the landing 58, as described more below. For example, other arrangements are possible wherein both supports 28, 30 are located on steps, the upper support 30 is instead located on the landing 58, etc. In addition, a slope or inclination angle of the rails 32, 34 may be generally parallel to a slope or inclination (e.g., a rise/run) of the stairs 18; however, this is not required either. The slope of many conventional stairways is in accordance with the so-called "7/11 rule"—i.e., seven units of rise for each eleven units of run. Thus, in at least one embodiment, the slope of the assembled rails 32, 34 is approximately 0.64 (or 7/11).

It should be appreciated that the assembled stand 20 may be freestanding—e.g., while the rails 32, 34 may be coupled to the supports 28, 30, the supports 28, 30 and/or rails 32, 34 need not be fixed to anything else. That is, the structure's configuration—coupled with the weight and design of the platform 22 (discussed below) may not require any anchoring of the supports 28, 30 and/or rails 32, 34 to existing structure (e.g., such as a wall, the staircase, etc.). As used herein, the term freestanding means not fixed, not attached, not connected, not coupled, and not adhered to walls, stair steps, banisters, or the like.

Figure 3:
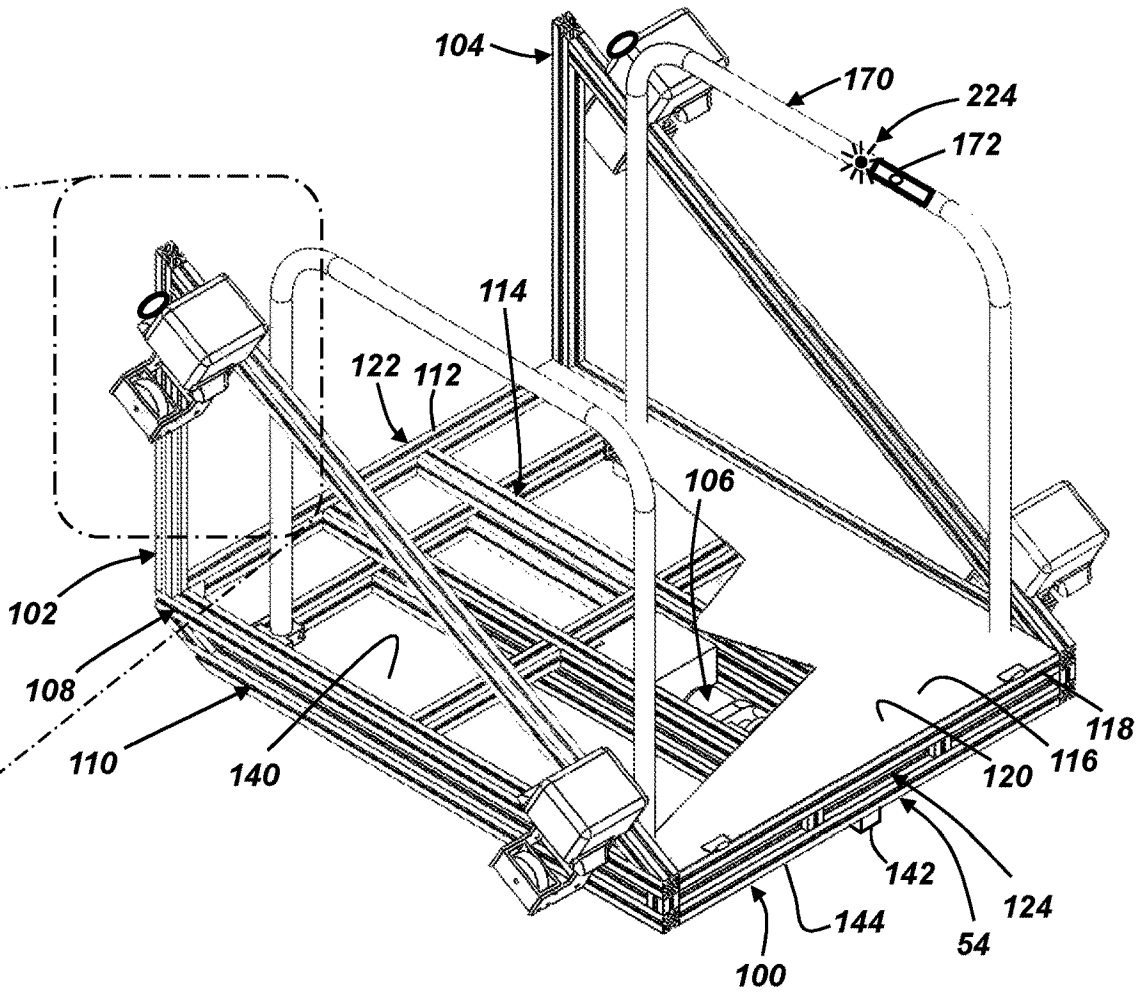
FIG. 3 illustrates a perspective view of a platform assembly of the lift apparatus.
Figure 4:
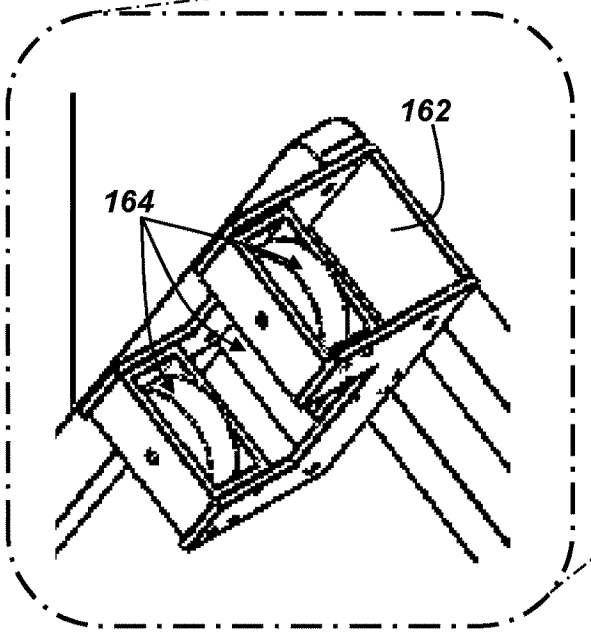
FIG. 4 is an enlarged perspective view of a portion of the platform assembly shown in FIG. 3, wherein a portion of a trolley housing is removed to expose the component therein.

Turning now to the platform 22 shown in FIGS. 3-5, the platform may include a base 100 sized to support an individual in a wheelchair, two carriers or carrier portions 102, 104 which couple the base to the rails 32, 34, and a mobility or powertrain system 106 integrated with the stand 20 that facilitates hands-free transport between the landing 58 and the floor 60. In at least one implementation, the base 100 may include a first or upper frame (or shelf) 108 coupled to a second or lower frame (or shelf) 110. The upper frame 108 may include any suitable structural body to support a wheelchair-bound individual 12 (e.g., it may be adapted to carry as much as 600-800 pounds (lbs)). As shown in FIG. 3, the body includes a peripheral member 112 and a number of cross-members 114 coupled to the peripheral member 112 to provide rigidity and strength; of course, this is merely exemplary. The upper frame 108 also may include a plate 116 coupled to a top side 118 of the body (or the plate may be integral thereto). A surface 120 of the plate 116 is preferably adapted to facilitate ease-of-rolling of the wheels of user's wheelchair 12. For example, the surface 120 may be smooth, or may be generally flat but have slip-resistant features (e.g., relatively small protrusions, ridges, depressions, channels, holes or grating, etc.). According to one embodiment, the surface 120 may be at least 36 inches wide (e.g., laterally) and 36 inches deep (e.g., between a leading edge 122 of the platform 22 and a trailing edge 124 thereof).

According to one embodiment, the upper frame 108 also includes one or more hinged ramps or chocks 126, 128 which may promote safety during use of the platform 22 (see FIG. 5). For example, a first hinged ramp 126 may be located at the leading edge 122 and may facilitate access to and from the landing 58. And for example, a second hinged ramp 128 may be located at the trailing edge 124 and may facilitate access to and from the lower floor 60. A preferred embodiment includes both ramps 126, 128. The length of the first and second hinged ramps 126, 128 may vary; however, in at least one embodiment, the ramps 126, 128 extend radially outwardly from at least one hinge element on the platform 22 and may be about 4 to 6 inches long.

In at least one embodiment, the first and second hinged ramps 126, 128 each include a safety sensor 130, 132 indicating whether the respective ramp 126, 128 is in a first or upward-facing position or in a lowered or down position (e.g., with respect to the base). The safety sensors 130, 132 may be in wired or wireless communication with platform electronics 54. And as will be explained more below, during operation, the ramps 126, 128 may be required to be in the upward-facing position in order for the mobility system to mobilize the platform 22. For example, in the upward-facing position the ramps 126, 128 may enclose or trap the wheels of the wheelchair 12 and provide a barrier or interference that inhibits the wheelchair-bound individual 12 and his/her chair from rolling off the platform 22 during transport. In addition, when the one or more hinged ramps 126, 128 are in the down position, the ramps 126, 128 may facilitate easier access onto and off of the platform 22 by wheelchair-bound individuals 12.

The lower frame 110 may be constructed similarly to the upper frame 108; therefore, it will not be re-described here. When assembled, the lower frame 110 may be spaced from the upper frame defining a cavity 140 therebetween (FIG. 3)—and the cavity 140 may be suitably sized to accommodate components of the mobility system, as will be described more below. According to one implementation, a height of the cavity 140 (or a spacing between the upper and lower frames 108, 110) is approximately 3-6 inches; however, this is merely an example and other spacing embodiments are possible. In at least one embodiment, the cavity 140 may be enclosed using walls around the cavity 140 (coupled to the upper and lower frames 108, 110), etc. to minimize or inhibit contact between the mobility system components and the apparatus' 10 environment (e.g., rain, snow, etc.).

In one embodiment, the lower frame 110 includes a contact or proximity sensor 142 mounted on a bottom side 144 thereof for detecting when the platform 22 is close to or in contact with the floor 60. For example, one non-limiting implementation of this sensor 142 is a pressure sensor having a plunger which is actuated as the bottom side of the platform 22 touches the floor; e.g., when actuated, the sensor 142 may communicate with platform electronics 54 which in turn may cease driving or moving the platform 22, as will be explained more below.

Other embodiments of the base 100 include implementations without the lower frame 110. For example, the mobility system components may be mounted in other locations on the platform 22 (e.g., such as on an underside of the upper frame 108). Further, a cover or hood (not shown) could be located thereover to protect components from weather elements and the like.

Turning now to the carriers 102, 104 best shown in FIGS. 3 and 5, each of the carriers 102, 104 may be identical; therefore, only one will be described below. According to one embodiment (see FIG. 5), carrier 102 may include a bracket 148 adapted to carry at least one wheel assembly or trolley 150 which is/are adapted to enable the platform 22 to traverse upwardly and downwardly along a respective rail (e.g., 32). The illustrated bracket 148 is embodied as a post 152 that extends outwardly of the upper frame 108 and a connecting segment 154 that extends from an upper end 156 of the post 152 to the upper frame 108 having a slope or inclination angle that may be similar to the slope of the rail 34; of course, this is merely an example. In at least the illustrated implementation, the post 152 is located proximate to the leading edge 122 of the base 100, while the connecting segment 154 adjoins the upper frame 108 in a location that is proximate to the trailing edge 124 of the base. In at least one embodiment, the length of the extending portion 72 of the guide rail 34 (discussed above) may be at least as long as the length of the connecting segment 154, so that the platform 22 does not fall off of or derail from the lower ends of the guide rails 34.

Other carrier embodiments are contemplated as well. For example, each carrier 102, 104 could comprise two posts 152 extending outwardly from the base (e.g., a longer post and a shorter post); or each carrier 102, 104 could comprise a triangularly-shaped wall that extends outwardly from the base, etc. In at least one embodiment, the carriers are located at lateral or outboard regions 158, 160 of the platform—e.g., to provide adequate space for the user's wheelchair 12 on the surface of the base 100, and to provide additional space for foot traffic.

In at least one embodiment, the bracket 154 (e.g., the connecting segment) carries two trolleys 150—e.g., wherein one trolley is spaced farther from the base than the other trolley; however, two trolleys are not required, nor is this particular arrangement required. Each trolley 150 may be identical; therefore, only one will be described below. The trolley 150 may comprise any device which both secures the platform 22 to the rail 34 and promotes travel therealong. For example, the trolley 150 may include a housing having wheels, bearings, lubricants, etc. to traverse smoothly along the guide rails 32, 34 with minimized resistance while also positively inhibiting a derailing event (e.g., where the platform 22 slips off the guide rails 32, 34 or the like). For example, the illustrated embodiments include a housing 162 and a three wheel set 164, wherein the wheels??? are adapted to contact and roll along different axial sides of the guide rail 34 (see also FIG. 4). For example, one wheel may ride along the upper track region 66, another wheel along the lower track region 68, and a third wheel along the lateral track region 70 in the manner shown and described in U.S.

Pat. No. 5,272,984, the entirety of which is incorporated by reference. This is merely an example; other implementations are possible.

One of the trolleys on each carrier 102, 104 (e.g., the uppermost trolley) may include a contact or proximity sensor 166 mounted on a side 168 of the housing that faces the upper support 30; this sensor 166 may be used to detect instances when the platform 22 is close to the landing 58. For example, one non-limiting implementation of this sensor 166 is a sensor having a plunger which is actuated when the sensor 166 on the trolley 150 engages the stop 76 on rail 34 (e.g., or rail 32), which is adapted to stop movement of the platform 22, as described below. This is merely one example; other embodiments are also possible.

In at least one embodiment, one or more handrails may be provided on the platform as well. For example, FIGS. 3 and 5 illustrates a pair of U-shaped handrails 170 extending from the upper frame 108 (and surface 120) spaced slightly inboard of the carriers 102, 104. These may be provided to assist the wheelchair-bound individual 12 when ingressing or egressing from the platform 22. In at least one embodiment, one of the handrails 170 may carry a second user interface device 172. The second user interface device 172 may include at least one operational switch 174 that, when actuated, sends a wired or wireless signal to the platform electronics 54 (discussed below) indicating that the user 12 wishes to ascend (or descend) the stairway 18. One non-limiting example includes the operational switch 174 being a three-position rocker switch—(positions of the switch corresponding to platform commands of 'up,' 'down,' or 'neutral').

Now turning to the mobility system 106 (see FIG. 6), the system may include a number of components such as a driving portion or motor 180, an onboard power source 182 to provide power to the motor, a driven portion or winch 184 which may be driven by the motor, a pair of cables 186, 188 coupled between the stand 20 and the winch 184, a circuit card assembly (CCA) 190, and one or more sensors (e.g., such as 130, 132, 142, 166, etc.). According to one embodiment, the driving portion 180 is an electric motor and the power source 182 is an onboard battery; however, this is not required (e.g., other implementations are possible). A shaft (not shown) of the motor 180 may drive the winch 184 to wind and unwind the cable(s) 186, 188, as will be appreciated by those skilled in the art. As will be appreciated from the description below, the motor 180 may have adequate power and torque to overcome the weight of the platform 22, its cargo (e.g., a wheelchair-bound individual 12), and any other opposing forces (e.g., friction between the trolleys and the rails, etc.).

Figure 6:
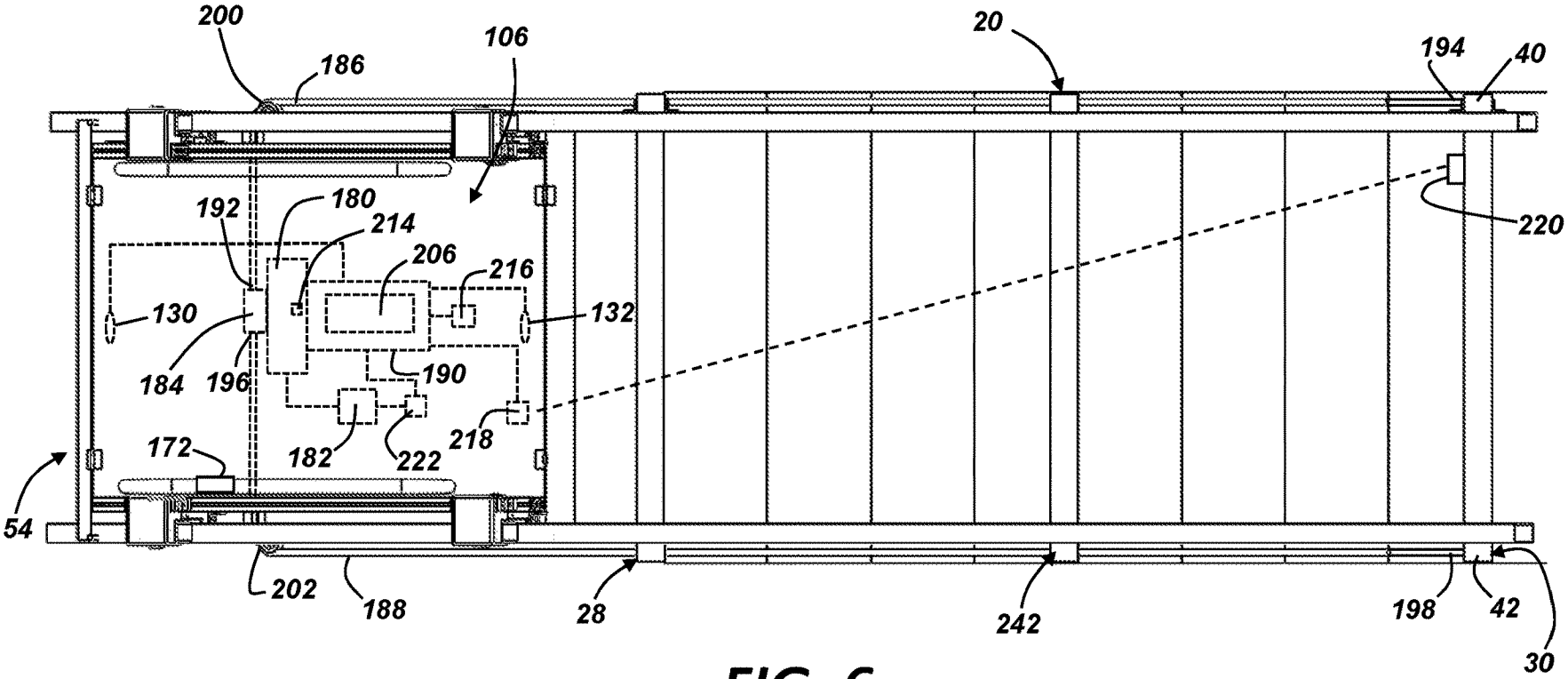
FIG. 6 illustrates a top view of the wheelchair lift apparatus.

As shown in FIG. 6, in at least one embodiment, the pair of cables 186, 188 may be used to lift and lower the platform 22. More particularly, one end 192 of the first cable 186 may be coupled to the winch 184, and an opposite end 194 may be coupled or anchored to the upper support 30 (e.g., to one of the upright members 40—see also FIG. 5). Similarly, one end 196 of the second cable 188 may be coupled to the winch 184, and an opposite end 198 may be coupled or anchored to the other upright member 42 of the upper support 30. In addition, one or more cable routing elements 200, 202 may be used to locate the cables 186, 188 around features of the stand 20 and platform 22—and may be arranged so not to be trip hazards to foot traffic that traverses the platform 22. For example, the first and second cables 186, 188 each could be routed from the winch 184 outwardly from the platform's base 100 to respectively located outboard pulleys, and from the respective pulleys, to the upright members 40, 42 of the upper support 30 (e.g., under or below the rails)—e.g., so that the first and second cables 186, 188 do not interfere with a foot path along the stairway 18. The illustrated cable routing elements 200, 202 are embodied as pulleys or sheaves; however, this is merely one example and others are possible (e.g., eyelets, grommets, etc.). Thus, it should be appreciated that when the motor 180 drives the winch in a first direction (e.g., winding clockwise), tension is placed on the cables 186, 188, and the platform 22 may be drawn toward the landing 58. Similarly, when the motor 180 drives the winch 184 in a second, opposite direction (e.g., unwinding or counter-clockwise), the platform 22 may be lowered toward the floor 60.

In the illustrated embodiment, a pair of cables are used; however, this is not required. For example, a single cable could be used in some embodiments. However, using two cables provides redundancy—e.g., in the event the first cable 186 fails, the second cable 188 may inhibit a wheelchair-bound individual 12 and his/her wheelchair from sliding rapidly down the guide rails 32, 34 and becoming injured.

Figure 9:
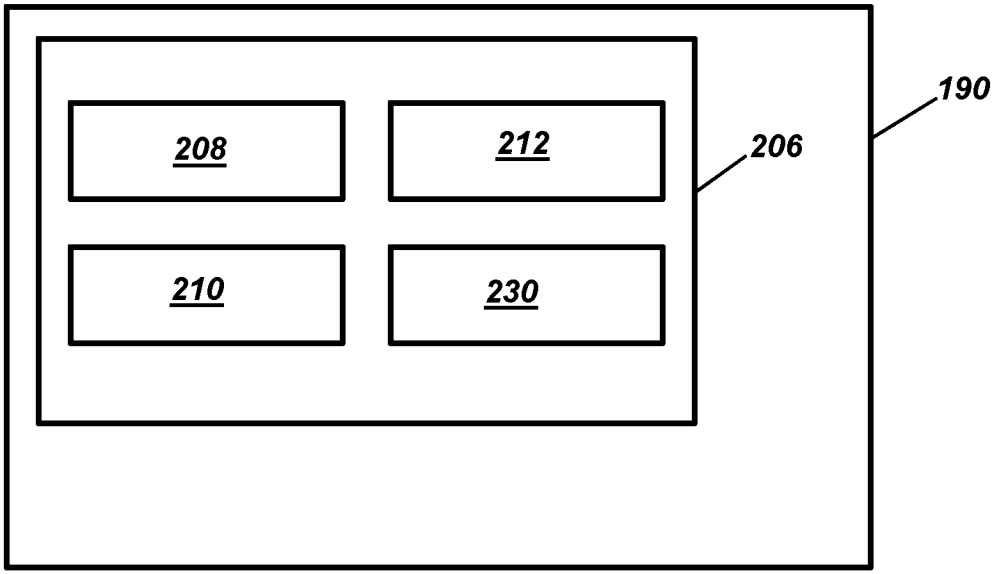
FIG. 9 is a schematic diagram of a circuit card assembly.

The circuit card assembly 190 (CCA, shown in FIG. 9) may include a control circuit 206 adapted to regulate the speed of the motor 180 and control the lift or elevating operations of the platform 22 based on sensor and switching input. For example, the circuit 206 may include any suitable hardware components, software components, or a combination thereof—including, but not necessarily requiring, a processor 208 and memory 210 storing instructions executable by the processor 208. It should be appreciated that a processor and memory are described below; however, the control circuit 206 could be arranged using discrete electronic components instead.

For example, instructions stored in memory 210 may include receiving an indication (a wired or wireless electrical signal) from the call switch 56 and retrieving the platform thereby. To illustrate, a signal may be received by a transceiver 212 on the control circuit 206 from the lower call switch 62, the processor 208 may determine that the platform 22 is at the landing 58, and the processor 208 may control the motor 180 to lower the platform 22 to the lower position 14. Of course, a similar operation may be performed when the platform 22 is at the floor 60 and a signal is received from the upper call switch 56. To accomplish this, additional sensors may be used; for example, the motor 180 may include a position sensor 214 (see FIG. 6) that indicates how much of the cable(s) are unwound—and the processor 208 may determine the platform's 22 location based on an electrical value received from the position sensor 214; other position sensors are also possible.

Other instructions may include receiving an indication (from the operational switch 174 on the handrail) that a wheelchair-bound user 12 is on the platform 22 and wishes to ascend to the landing 58. Before actuating the motor 180, the processor 208 may determine whether the hinged portions 126, 128 are in the upwardly-facing positions using input from the safety sensors 130, 132, and if it is determined that both hinged portions 126, 128 are in the upwardly-facing positions, then the processor 208 may control the motor 180 to turn the winch 184 in the first direction so that the platform 22 ascends the guide rails 32, 34. Alternatively, upon receiving an indication from switch 174, the hinged portions 126, 128 could raise automatically in response a trigger by the processor 208; then actuate the winch 184 so that the platform ascends the rails. Regardless, during the ascension, when the processor 208 receives an electrical signal from the trolley sensor 166 (e.g., when the sensor contacts the stop 166 on the rail 32 and/or 34), the processor 208 may cease actuating the motor 180 in this first direction. Thus, the sensor 166 may inhibit the platform 22 from progressing upwardly to the point that the platform 22 falls off the guide rails 32, 34. Additionally, input from the sensor 166 may inhibit the winch 184 from over-winding the cable(s) 186, 188 in the first direction—e.g., thereby preventing the cable(s) 186, 188 from breaking or separating from the support 30. Of course, a similar operation may be performed when the wheelchair-bound user 12 is on the platform 22 and wishes to descend to the floor 60. In this case, actuation that lowers the platform 22 may cease when the processor 208 receives an electrical signal from the sensor 142 on the bottom side 144 of the platform 22.

Other safety or inhibit sensors may be provided as well—e.g., a load sensor 216 (FIG. 6) may be carried by the base 100 and coupled to the control circuit 206. In general, this sensor may be used to identify that a user is on the platform 22 and inhibit undesirable platform movement. Consider for example when the lower call switch 62 is actuated while a wheelchair user 12 is on the platform 22 at the landing 58. The load sensor 216 may sense the wheelchair-bound user's 12 presence on the platform 22 and send an electrical signal to the control circuit 216, which may ignore call switch actuation.

In another example, an inhibit sensor 218 (FIG. 6) may be carried by the platform 22 to detect an obstruction on the stairway 18 at a time when the call switch 62 is actuated; e.g., the inhibit sensor 218 may be used to prevent the platform 22 from colliding with the obstruction. A non-limiting example of the inhibit sensor includes a laser emitter and detector 218 that seeks a laser return (mounted on the platform 22) and a reflector 220 mounted on the stand 20 (aligned with the laser). The processor 208 may receive no inhibit signal from the sensor 218 when the transmitted laser receives a return signal; however, if no return signal is received at the sensor 218, then the inhibit sensor 218 may provide a wired or wireless signal to the processor 208 and the processor 208 may inhibit movement of the platform 22 until the obstruction is cleared from the stairway path.

Another sensor may include a power-level sensor 222 (FIG. 6) coupled to the control circuit 206 and a power-level indicator 224 (shown in FIG. 5). For example, the power-level sensor 222 may sense a low voltage or low power condition associated with the platform power source 182, and the indicator 224 may be any suitable visual, audible, or tactile indicator which may be located on one of the handrails 170. In this manner, when the processor 208 receives an electrical signal from the power-level sensor 222 indicating a low voltage condition, the processor 208 may alert users of the lifting apparatus 10 via the indicator 224. Further, according to one embodiment, the processor 208 may inhibit movement of the platform 22 during low voltage conditions. According to another embodiment, if the processor 208 detects a low power condition, the platform 22 may be returned to the lower position 14 (floor) and may not be powered until the low power condition ceases (e.g., the battery is charged or replaced).

Some implementations of the lift apparatus 10 may include rechargeable power source cells. For example, when the lift apparatus 10 is adapted to outdoor use (e.g., outdoor stairs), the power source 182 may utilize solar cells to charge the power source. This of course is merely another example; other implementations are possible—including AC power implementations. In at least one embodiment, the power source 182 is DC power so that no electrical wiring between the platform 22 and the stand 20 is required and no electrical wiring between the environment (e.g., an AC wall outlet) and the platform 22 or stand 20 is required.

Still other implementations are possible using sensors. For example, a timer 230 of the control circuit 206 (FIG. 9) may send the platform 22 to the floor 60 automatically after a predetermined period of time has passed. For example, using the platform position sensor 214 (FIG. 6), the processor 208 may determine the location of the platform 22 with respect to the stand 20. If the position sensor 214 indicates that the platform 22 is located somewhere other than the lower position 14 and the predetermined period of time has expired with the platform 22 is in that position, then the platform 22 may be returned automatically to the lower position 14—controlled by the processor 208. In this manner, foot traffic may not be obstructed by the platform 22 remaining in the upper position 16 for long durations of time.

At least one embodiment of the wheelchair lift assist 10 includes a portable loading ramp 240, as shown in FIG. 1. The ramp 240 may provide a smooth transition for ingressing and egressing onto the platform 22 from the floor 60—e.g., particularly in implementations where the upper surface of the platform's base 100 is more than an inch above the floor 60. According to some embodiments, the loading ramp 240 may have any suitable width, a height between 1 and 5 inches, and a length of between 3 and 6 feet. In some implementations, the ramp 240 is coupled to the lower support 28 or the platform 22; however, this is not required. It should be appreciated that embodiments exist with and without the loading ramp 240.

Other embodiments of the wheelchair lift apparatus 10 also exist. For example, the trolleys 150 could be motorized to move the platform 22 up and down along the guide rails—e.g., a cable-less system. Any suitable means could be provided to enable the platform 22 to ascend and descend the stand 20. For example, the guide rails could have teeth that mesh with a motorized trolley gear. Other features may be generally similar to those described above—e.g., enabling the wheelchair-bound individual 12 to similarly use the lift apparatus 10 while also enabling non-wheelchair-bound individuals to walk up and down the stairway 18.

According to another embodiment of the lift apparatus 10, three or more supports may be used. For example, as shown in FIG. 6, a third or middle support 242 may be used. This may be suitable for some longer stairways.

At least some implementations described herein may utilize the processor 208 and memory 210. The processor 208 described herein may be any type of device capable of processing electronic instructions, non-limiting examples including a microprocessor, microcontroller, host processor, controller, vehicle communication processor, and an application specific integrated circuit (ASIC). Processor executes digitally-stored instructions, which may be stored in memory, which enable the control circuit to perform one or more wheelchair lift functions.

Memory 210 may include any non-transitory computer usable or readable medium, which include one or more storage devices or articles. Exemplary non-transitory computer usable storage devices include conventional computer system RAM (random access memory), ROM (read only memory), EPROM (erasable, programmable ROM), EEPROM (electrically erasable, programmable ROM), and magnetic or optical disks or tapes. As discussed above, memory 210 may store one or more computer program products which may be embodied as software and/or firmware. For example, memory may store instructions which enable the control circuit 206 to facilitate at least a portion of the method described herein.

Thus, there has been described a wheelchair lift apparatus that enables wheelchair-bound individuals to traverse between a floor and an elevated landing—e.g., over various obstacles. In one embodiment, the apparatus carries a wheelchair-bound individual up and down stairways. When the apparatus is not being used, the stairway is usable by non-wheelchair-bound individuals—e.g., foot traffic. In general, the apparatus may be portable and installable without needing to be fixed to existing structures or the stairway itself. The apparatus includes a stand and a mobilized platform adapted to carry the wheelchair-bound individual safely between the floor and landing.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A wheelchair lift apparatus, comprising:

a stand that includes a pair of inclined rails; and a platform for carrying a wheelchair, wherein the platform includes a driving portion and a driven portion for moving the platform along the rails, wherein, when the driving portion actuates the driven portion in a first direction, the platform ascends along the rails, wherein, when the driving portion actuates the driven portion in a second and opposite direction, the platform descends along the rails, wherein a base of the platform further comprises at least one hinged chock, wherein the platform includes a sensor that detects whether the at least one hinged chock is angled upwardly with respect to the base, wherein the driving portion is inhibited from actuating when the at least one hinged chock is not angled upwardly with respect to the based, wherein the platform includes an upper frame vertically spaced from a lower frame, the upper frame directly above the lower frame, the upper frame extending parallel to the lower frame, and wherein a cavity is defined between the upper frame and the lower frame, the driving portion is in the cavity, wherein the platform includes a plate supported by the upper frame, and wherein the upper frame and the lower frame each include peripheral members extending about a perimeter of the platform, the peripheral members of the upper frame directly above the peripheral members of the lower frame, the peripheral members further defining the cavity.

2. The apparatus of claim 1, wherein the stand further comprises a first support and a second support, wherein the first and second supports carry the pair of inclined rails, wherein the second support is in an elevated position with respect to the first support, wherein the rails extend between the first and second supports.

3. The apparatus of claim 2, wherein the first and second supports are each freestanding.

4. The apparatus of claim 2, wherein the platform further comprises a pair of carriers that couple a base of the platform to the rails, wherein each carrier comprises a post coupled to a connecting segment, wherein each post and connecting segment are coupled to the base, wherein each rail comprises an extending portion that extends between a floor and the first support, wherein a length of each extending portion is at least as long as the connecting segment of each carrier.

5. The apparatus of claim 1, wherein at least one of the pair of inclined rails includes a stop, wherein the platform comprises at least two trolleys for conveying the platform along the rail, wherein the stop inhibits the platform from further ascending the rails.

6. The apparatus of claim 5, wherein the platform comprises a sensor that electrically halts the platform's ascension when the sensor detects the stop.

7. The apparatus of claim 1, further comprising at least one cable coupling the stand and the driven portion, wherein the driving portion is an electric motor, wherein the driven portion is a winch operable to wind the cable in the first direction and unwind the cable in the second direction.

8. The apparatus of claim 7, wherein the stand is adapted for a stairway, further comprising a first cable, a second cable, and one or more cable routing elements, wherein, using the one or more cable routing elements, the first and second cables are routed outboard of a base of the platform below the respective inclined rails so that the first and second cables do not interfere with a foot path along the stairway.

9. The apparatus of claim 1, wherein the platform further comprises: a base for supporting the wheelchair and a pair of carriers adapted to traverse along the rails when the driving portion actuates the driven portion.

10. The apparatus of claim 1, wherein the platform further comprises a control circuit adapted to control the driving portion in response to receiving electrical inputs from a plurality of sensors located on the platform.

11. The apparatus of claim 1, wherein the stand further comprises at least one user interface that includes a call switch adapted to communicate with a transceiver onboard the platform, wherein in response to receiving a page from the user interface, the platform ascends or descends the rails.

12. The apparatus of claim 1, further comprising a loading ramp adapted to enable a wheelchair-bound individual to ingress the platform when an upper surface of the platform is located above a floor or first level.

13. The wheelchair lift apparatus of claim 1, wherein the platform includes a post at a front of the platform, the post extending upward from the plate to a distal end, wherein the platform includes a bracket extending from the rear of the platform at the plate to the distal end of the post, the plate, post, and bracket forming a triangle, and wherein the platform includes a first trolley and a second trolley, the first and second trollies fixed to the bracket, the first trolley further from the plane than the second trolley.

14. The wheelchair lift apparatus of claim 13, wherein the upper frame and the lower frame each include first cross-members extending between the front and the rear of the platform and second cross-members extending between sides of the platform, the first cross-members perpendicular to the second cross-members, the first and second cross-members of the upper frame directly above the first and second cross-members of the lower frame, and the first and second cross-members further defining the cavity.

15. A wheelchair lift apparatus for a stairway, comprising:

a stand that includes an upper support, a lower support, and a pair of rails coupling the upper and lower supports to one another; and a platform for carrying a wheelchair-bound individual, wherein the platform includes a driving portion and a driven portion for moving the platform along the rails, wherein, when the driving portion actuates the driven portion in a first direction, the platform ascends along the rails, wherein, when the driving portion actuates the driven portion in a second and opposite direction, the platform descends along the rails, wherein a base of the platform further comprises at least one hinged chock, wherein the platform includes a sensor that detects whether the at least one hinged chock is angled upwardly with respect to the base, wherein the driving portion is inhibited from actuating when the at least one hinged chock is not angled upwardly with respect to the base, wherein the platform includes an upper frame vertically spaced from a lower frame, the upper frame directly above the lower frame, the upper frame extending parallel to the lower frame, and wherein a cavity is defined between the upper frame and the lower frame, the driving portion is in the cavity, wherein the platform includes a plate supported by the upper frame, and wherein the upper frame and the lower frame each include peripheral members extending about a perimeter of the platform, the peripheral members of the upper frame directly above the peripheral members of the lower frame, the peripheral members further defining the cavity.

16. The apparatus of claim 15, wherein the upper and lower supports are each freestanding, wherein the platform further comprises a pair of carriers that couple a base of the platform to the rails, wherein each carrier comprises a post coupled to a connecting segment, wherein each post and connecting segment are coupled to the base, wherein each rail comprises an extending portion that extends between a floor and the lower support, wherein a length of each extending portion is at least as long as the connecting segment of each carrier.

17. The apparatus of claim 15, wherein at least one of the pair of rails includes a stop, wherein the platform comprises at least two trolleys for conveying the platform along the rail, wherein the stop inhibits the platform from further ascending the rails.

18. The apparatus of claim 17, further comprising at least one cable coupling the stand and the driven portion, wherein the driving portion is an electric motor, wherein the driven portion is a winch operable to wind the cable in the first direction and unwind the cable in the second direction.

19. The apparatus of claim 18, further comprising a first cable, a second cable, and one or more cable routing elements, wherein, using the one or more cable routing elements, the first and second cables are routed outboard of a base of the platform below the respective rails so that the first and second cables do not interfere with a foot path along the stairway.

20. The wheelchair lift apparatus of claim 15, wherein the platform includes a post at a front of the platform, the post extending upward from the plate to a distal end, wherein the platform includes a bracket extending from the rear of the platform at the plate to the distal end of the post, the plate, post, and bracket forming a triangle, and wherein the platform includes a first trolley and a second trolley, the first and second trollies fixed to the bracket, the first trolley further from the plane than the second trolley, wherein the upper frame and the lower frame each include first cross-members extending between the front and the rear of the platform and second cross-members extending between sides of the platform, the first cross-members perpendicular to the second cross-members, the first and second cross-members of the upper frame directly above the first and second cross-members of the lower frame, and the first and second cross-members further defining the cavity.

* * * * *